US005692751A

United States Patent [19]

Morrissey et al.

[11] Patent Number: 5,692,751

[45] Date of Patent: Dec. 2, 1997

[54] GOLF BOARD GAME

[76] Inventors: Chris W. Morrissey; Antonietta L. Morrissey, both of 1375 Bobolink Court, Peterborough, Ontario, Canada, K9K 2H9

[21] Appl. No.: 787,951

[22] Filed: Jan. 23, 1997

[51] Int. Cl.[6] ..... A63F 3/00

[52] U.S. Cl. ..... 273/245; 273/431

[58] Field of Search ..... 273/243, 244, 273/245, 259, 429, 430, 431, 432

[56] References Cited

U.S. PATENT DOCUMENTS

| | | | |
|---|---|---|---|
| 2,157,172 | 5/1939 | Hays | 273/245 |
| 3,944,229 | 3/1976 | Feeney | 273/245 |
| 3,989,249 | 11/1976 | Breslow | 273/245 X |
| 5,518,248 | 5/1996 | Lightfoot | 273/245 |

FOREIGN PATENT DOCUMENTS

| | | | |
|---|---|---|---|
| 2220147 | 1/1990 | United Kingdom | 273/245 |

OTHER PUBLICATIONS

"Tee–Rivia", *Worldwide Games Catalog*, Autumn 1994, p. 16.

*Primary Examiner*—William E. Stoll

[57] ABSTRACT

A new Golf Board Game for simulating the game of golf. The inventive device includes a game board having an illustration of a golf course thereon, wherein the golf course is divided into a plurality of playing holes, and a plurality of playing pieces to be moved among the playing holes of the golf course. A plurality of query cards and a plurality of golf club cards having a question and an answer for each of a number of subject matter categories and an outcome of a simulated golf shot provided thereon, respectively, are provided for determining movement of the playing pieces among the playing holes of the golf course. Throughout the game, one of the plurality of query cards is selected and a question is read. The player provides an answer to the read question and a determination is made as to whether the provided answer is correct. The player then selects one of the plurality of golf club cards corresponding to a desired golf club selected for making a simulated golf shot on one of the plurality of playing holes of the golf course. The playing piece is moved to a resulting shot position according to the outcome provided on the golf club card corresponding to the correctness of the provided answer.

16 Claims, 5 Drawing Sheets

GOLF BOARD GAME

BACKGROUND OF THE INVENTION

1. Field of the Invention

The present invention relates to golf games and more particularly pertains to a new Golf Board Game for simulating the game of golf.

2. Description of the Prior Art

The use of golf games is known in the prior art. More specifically, golf games heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf games include U.S. Pat. No. 5,316,302; U.S. Pat. No. D327,297; U.S. Pat. No. D341,383; U.S. Pat. No. 4,759,548; U.S. Pat. No. 5,413,349 and U.S. Pat. No. 5,358,248.

While these devices fulfill their respective, particular objectives and requirements, the aforementioned patents do not disclose a new Golf Board Game. The inventive device includes a game board having an illustration of a golf course thereon, wherein the golf course is divided into a plurality of playing holes, and a plurality of playing pieces to be moved among the playing holes of the golf course. A plurality of query cards and a plurality of golf club cards having a question and an answer for each of a number of subject matter categories and an outcome of a simulated golf shot provided thereon, respectively, are provided for determining movement of the playing pieces among the playing holes of the golf course.

In these respects, the Golf Board Game according to the present invention substantially departs from the conventional concepts and designs of the prior art, and in so doing provides an apparatus primarily developed for the purpose of simulating the game of golf.

SUMMARY OF THE INVENTION

In view of the foregoing disadvantages inherent in the known types of golf games now present in the prior art, the present invention provides a new Golf Board Game construction wherein the same can be utilized for simulating the game of golf.

The general purpose of the present invention, which will be described subsequently in greater detail, is to provide a new Golf Board Game apparatus and method which has many of the advantages of the golf games mentioned heretofore and many novel features that result in a new Golf Board Game which is not anticipated, rendered obvious, suggested, or even implied by any of the prior art golf games, either alone or in any combination thereof.

To attain this, the present invention generally comprises a game board having an illustration of a golf course thereon, wherein the golf course is divided into a plurality of playing holes, and a plurality of playing pieces to be moved among the playing holes of the golf course. A plurality of query cards and a plurality of golf club cards having a question and an answer for each of a number of subject matter categories and an outcome of a simulated golf shot provided thereon, respectively, are provided for determining movement of the playing pieces among the playing holes of the golf course.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Golf Board Game apparatus and method which has many of the advantages of the golf games mentioned heretofore and many novel features that result in a new Golf Board Game which is not anticipated, rendered obvious, suggested, or even implied by any of the prior art golf games, either alone or in any combination thereof.

It is another object of the present invention to provide a new Golf Board Game which may be easily and efficiently manufactured and marketed.

It is a further object of the present invention to provide a new Golf Board Game which is of a durable and reliable construction.

An even further object of the present invention is to provide a new Golf Board Game which is susceptible of a low cost of manufacture with regard to both materials and labor, and which accordingly is then susceptible of low prices of sale to the consuming public, thereby making such Golf Board Game economically available to the buying public.

Still yet another object of the present invention is to provide a new Golf Board Game which provides in the apparatuses and methods of the prior art some or the advantages thereof, while simultaneously overcoming some of the disadvantages normally associated therewith.

Still another object of the present invention is to provide a new Golf Board Game for simulating the game of golf.

Yet another object of the present invention is to provide a new Golf Board Game which includes a game board having an illustration of a golf course thereon, wherein the golf course is divided into a plurality of playing holes, and a plurality of playing pieces to be moved among the playing holes of the golf course. A plurality of query cards and a plurality of golf club cards having a question and an answer for each of a number of subject matter categories and an outcome of a simulated golf shot provided thereon, respectively, are provided for determining movement of the playing pieces among the playing holes of the golf course.

Still yet another object of the present invention is to provide a new Golf Board Game that offers an entertaining and exciting board game with a golfing theme.

Even still another object of the present invention is to provide a new Golf Board Game that can educate a player on the fundamentals of golf.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
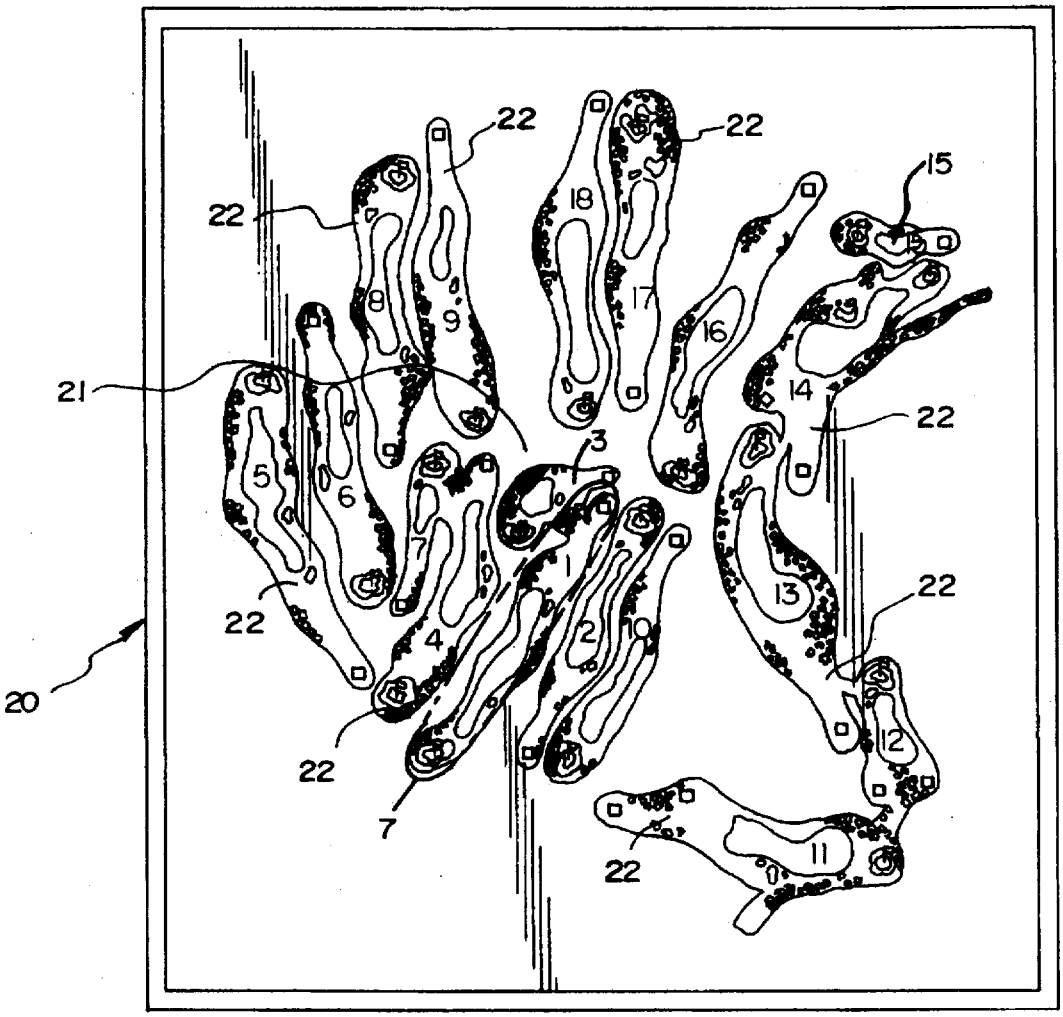
FIG. 1 is an illustration of a game board of a new Golf Board Game according to the present invention.

With reference now to the drawings, and in particular to FIGS. 1 through 9 thereof, a new Golf Board Game embodying the principles and concepts of the present invention and generally designated by the reference numeral 10 will be described.

More specifically, it will be noted that the Golf Board Game 10 comprises a game board 20 having an illustration of a golf course 21 thereon, wherein the golf course 21 is divided into a plurality of playing holes 22, and a plurality of playing pieces 30 to be moved among the playing holes 22 of the golf course 21. A plurality of query cards 40 and a plurality of golf club cards 50 having a question and an answer for each of a number of subject matter categories and an outcome of a simulated golf shot provided thereon, respectively, are provided for determining movement of the playing pieces 30 among the playing holes 22 of the golf course 21.

Figure 7:
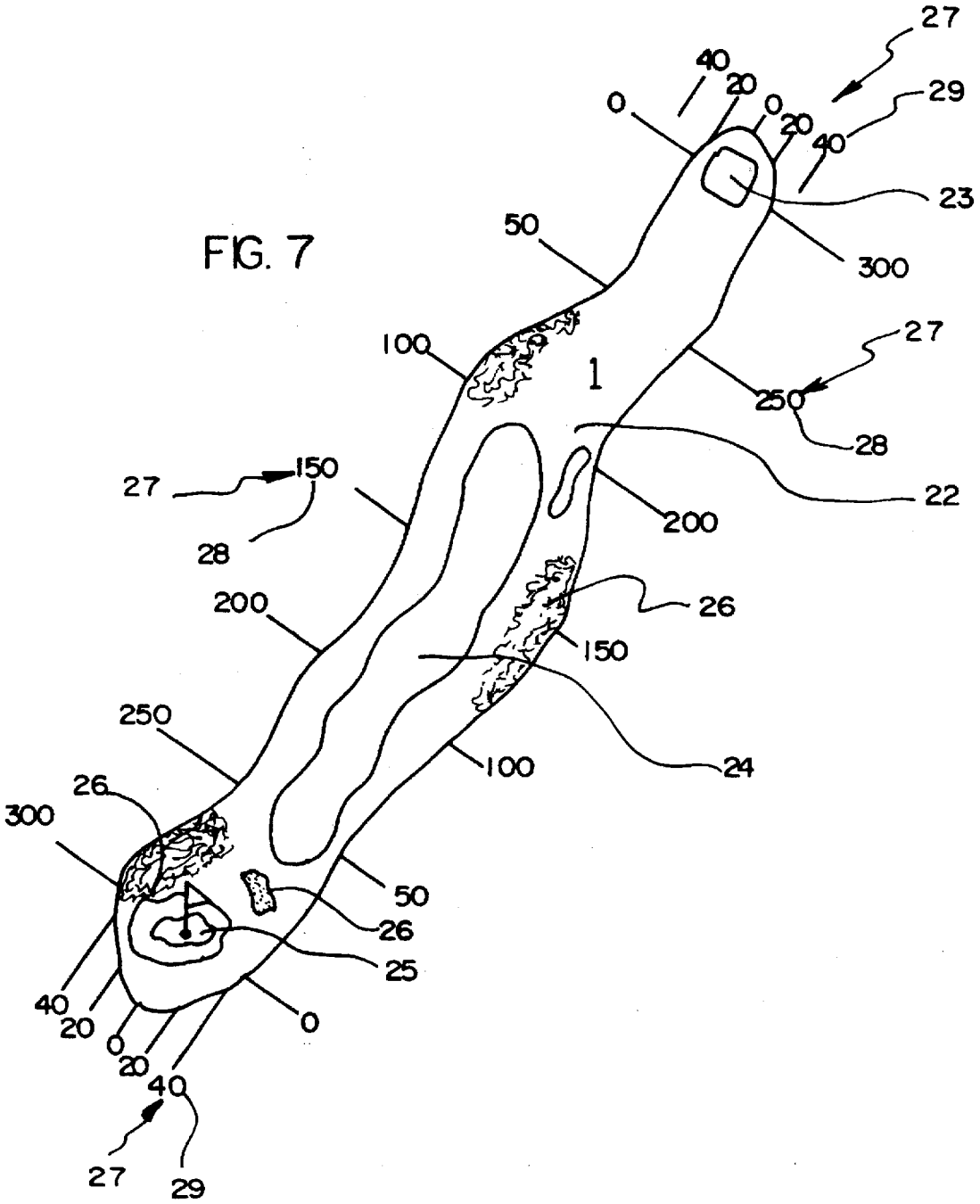
FIG. 7 is an enlarged illustration of playing hole 1 of FIG. 1.
Figure 8:
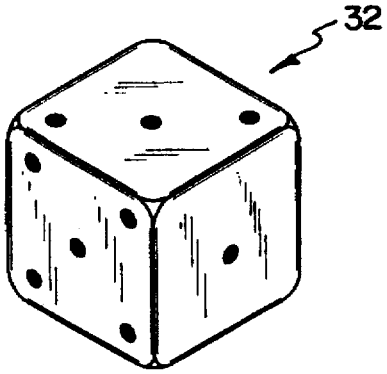
FIG. 8 is an illustration of a die for use with the present invention.
Figure 9:
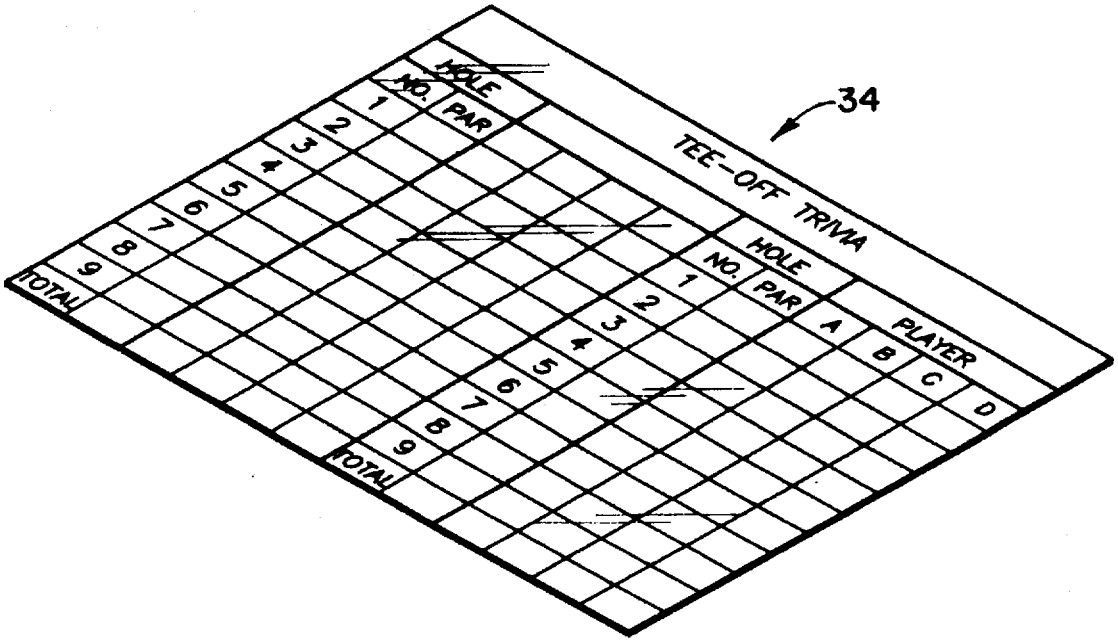
FIG. 9 is an illustration of a scoring card for use with the present invention.

As best illustrated in FIGS. 1 and 7, it can be shown that the golf course 21 has eighteen playing holes 22 illustrated thereon. Each of the plurality of playing holes 22 of the golf course 21 has a tee area 23 illustrated thereon, a fairway area 24 illustrated thereon, a green area 25 illustrated thereon, and at least one hazard area 26 illustrated thereon. The hazard area 26 includes at least one of a bunker area, a water area, a sandtrap area, a tree area, and an out-of-bounds area. Each of the plurality of playing holes 22 of the golf course 21 has yardage indicia 27 illustrated thereon. The yardage indicia 27 comprises horizontal yardage indicia 28 for indicating a horizontal distance between the tee area 23 and the green area 25 and deviation yardage indicia 29 for indicating a deviation distance from a centerline of the fairway area 24.

Figure 2:
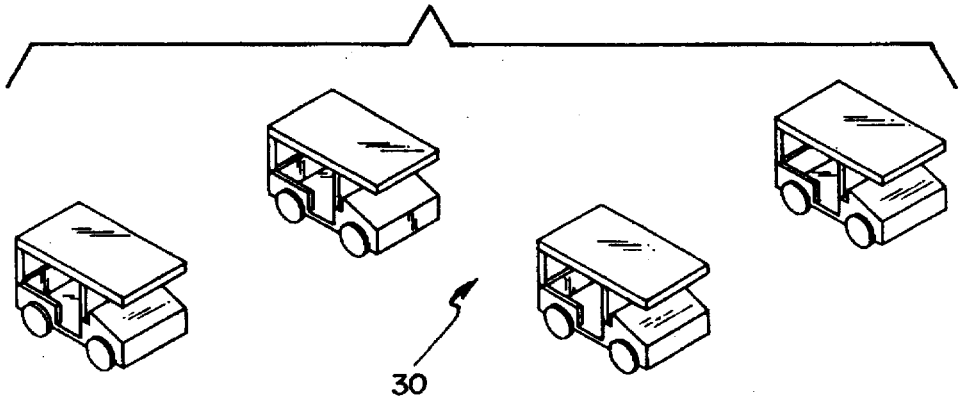
FIG. 2 is an illustration of a playing piece of the present invention.

As best illustrated in FIG. 2, it can be shown that each of the plurality of playing pieces 30 are in the shape of a golf cart.

Figure 3:
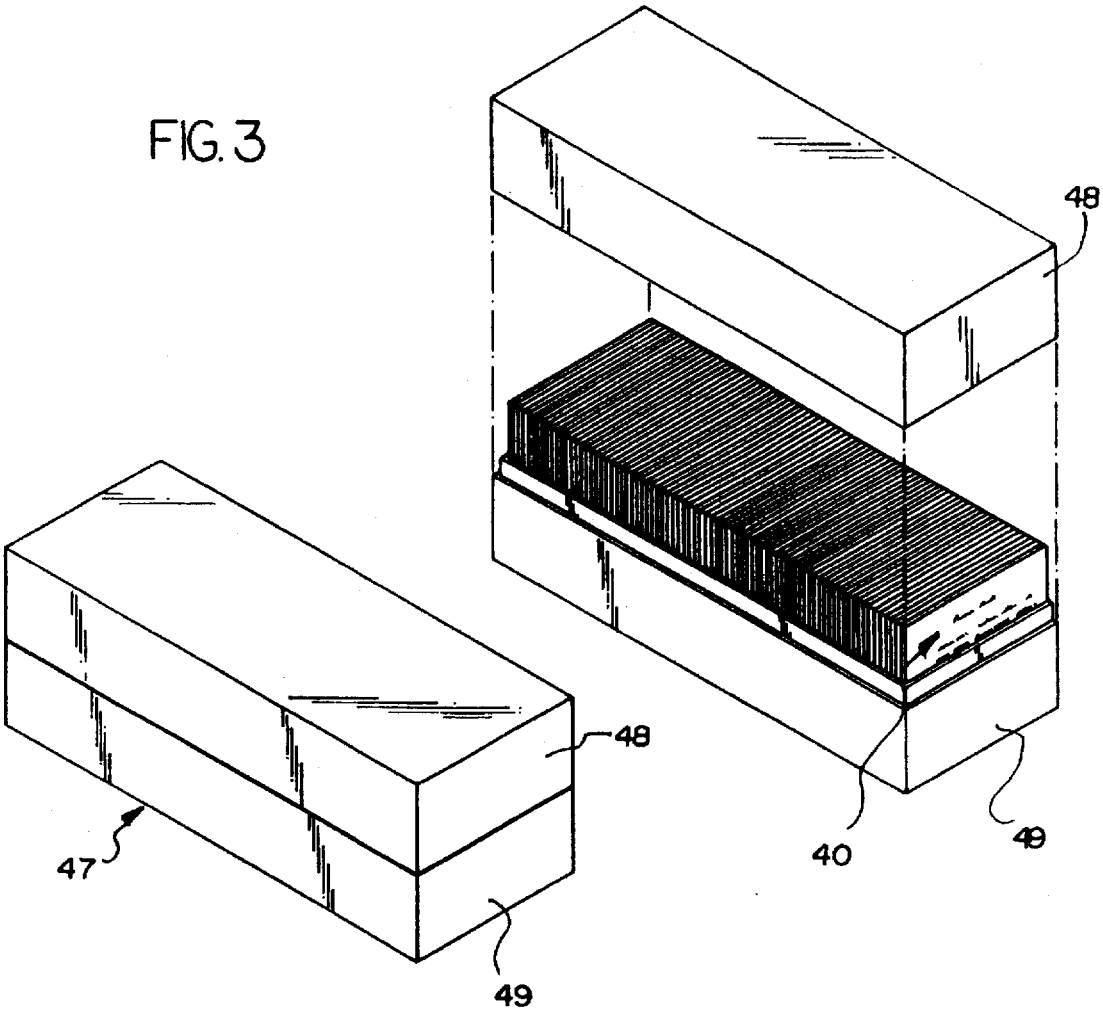
FIG. 3 is an illustration of the plurality of query cards of the present invention.
Figure 4A:
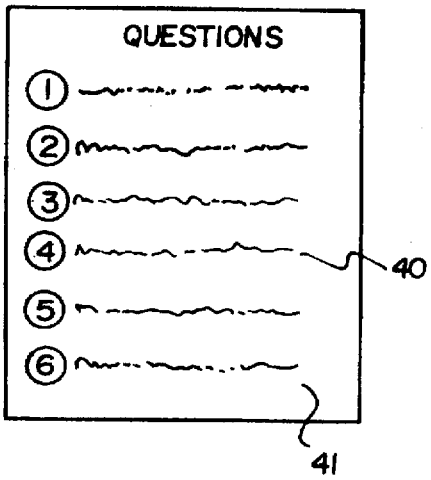
FIG. 4*a* is an exemplary illustration of a first side of a query card of the present invention.
Figure 4B:
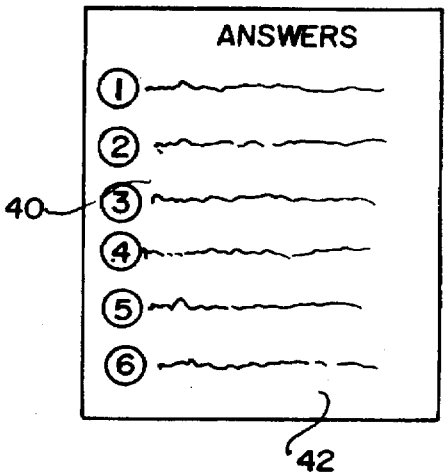
FIG. 4*b* is an exemplary illustration of a second side of a query card of the present invention.

As best illustrated in FIGS. 4*a* and 4*b*, it can be shown that each of the plurality of query cards 40 has provided thereon a question and an answer for each of a number of subject matter categories. The question is provided on a first side 41 of each of the plurality of query cards 40 and the answer is provided on a second side 42 of each of the plurality of query cards 40. The number of subject matter categories include a history category, an art and literature category, a sports category, an entertainment category, a geography and nature category, and a miscellaneous category. A six-sided die 32 is provided for determining from which of the number of subject matter categories a question shall be selected. As best illustrated in FIG. 3, it can be shown that a query card storage box 47 is provided for storage of the plurality of query cards 40. The query card storage box 47 comprises a bottom section 49 for retaining the plurality of query cards 40 and a mating top section 48 for containing the plurality of query cards 40 in the bottom section 49.

Figure 5:
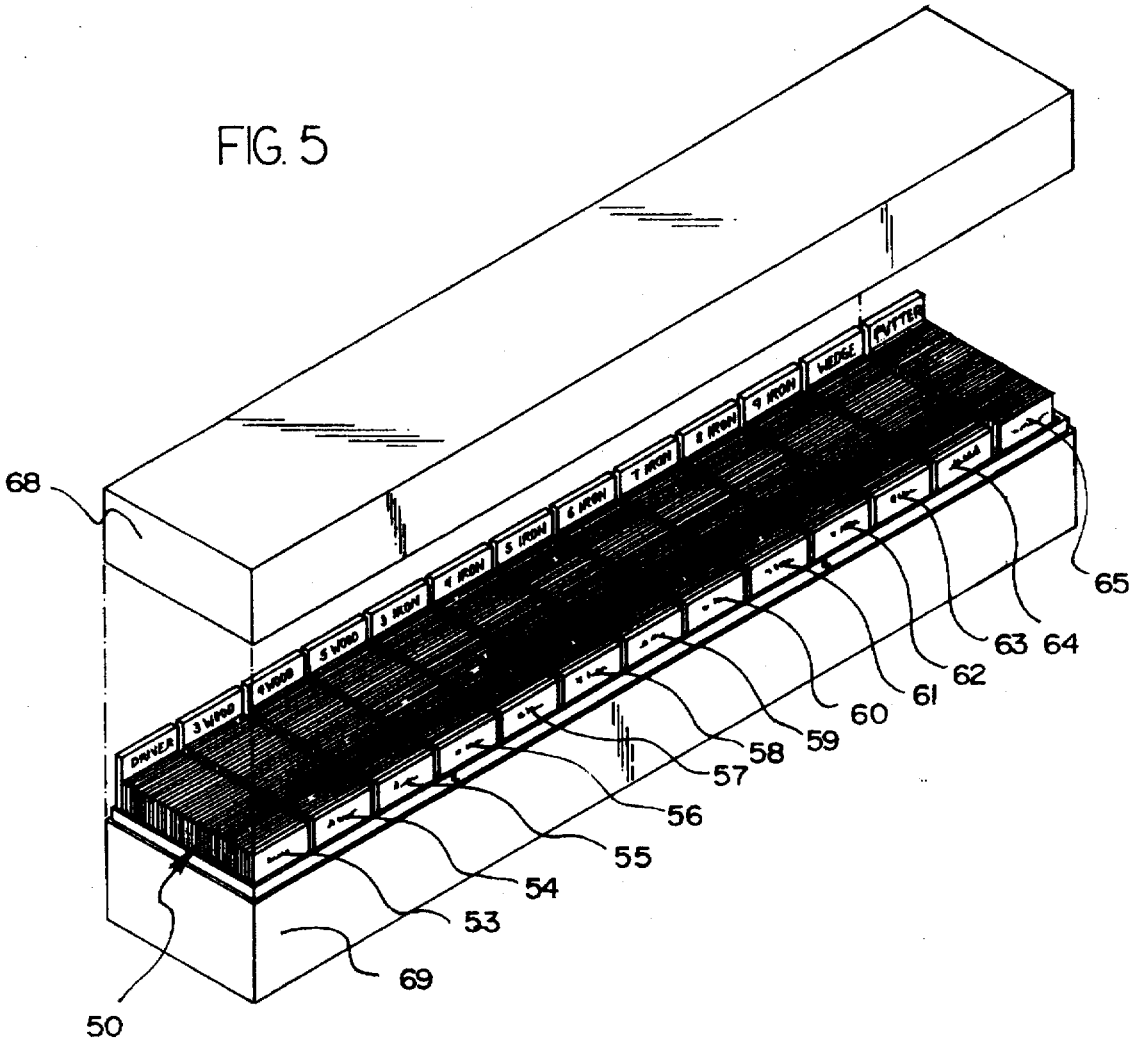
FIG. 5 is an illustration of the plurality of golf club cards of the present invention.

As best illustrated in FIG. 5, it can be shown that the plurality of golf club cards 50 corresponds to a desired golf club selected for making a simulated golf shot. The plurality of golf club cards 50 comprises a plurality of Driver Cards 53, a plurality of 3 Wood Cards 54, a plurality of 4 Wood Cards 55, a plurality of 5 Wood Cards 56, a plurality of 3 Iron Cards 57, a plurality of 4 Iron Cards 58, a plurality of 5 Iron Cards 59, a plurality of 6 Iron Cards 60, a plurality of 7 Iron Cards 61, a plurality of 8 Iron Cards 62, a plurality of 9 Iron Cards 63, a plurality of Pitching Wedge Cards 64, and a plurality of Putter Cards 65. A plurality of Bunker Cards and a plurality of Chip Shot Cards may also be included for corresponding golf shots. A golf club card storage box 67 is provided for storage of the plurality of golf club cards 50. The golf club card storage box 67 comprises a bottom section 69 for retaining the plurality of golf club cards 50 and a mating top section 68 for containing the plurality of golf club cards 50 in the bottom section 69.

Figure 6A:
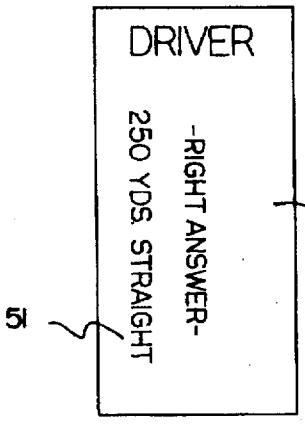
FIG. 6*a* is an exemplary illustration of a first side of a golf club card of the present invention.
Figure 6B:
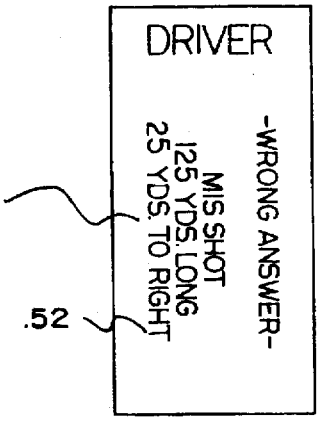
FIG. 6*b* is an exemplary illustration of a second side of a golf club card of the present invention.

As best illustrated in FIGS. 6*a* and 6*b*, it can be shown that each of the plurality of golf club cards 50 has provided thereon a first outcome of the simulated golf shot and a second outcome of the simulated golf shot. The first outcome and the second outcome include at least one of a distance of the simulated golf shot, a direction of the simulated golf shot, a final resting position of the simulated golf shot, and a stroke number for the simulated golf shot. The first outcome is provided on a first side 51 of each of the plurality of golf club cards 50 and the second outcome is provided on a second side 52 of each of the plurality of golf club cards 50. The first outcome corresponds to a correct answer provided in response to a question from one of the plurality of query cards 40. The second outcome corresponds to an incorrect answer provided in response to a question from one of the plurality of query cards 40. In essence, the correctness of the answer provided to the question will determine a resulting shot position of the simulated golf shot with the selected golf club.

A scoring card 34 is provided for tracking the number of strokes required for a player to complete each of the plurality of playing holes 22 of the golf course 21 during play of the game 10.

To play the game 10, a game board 20 having an illustration of a golf course 21 thereon, wherein the golf course 21 is divided into a plurality of playing holes 22, a plurality of query cards 40 having provided thereon a question and an answer for each of a number of subject matter categories, and a plurality of golf club cards 50 having provided thereon an outcome of a simulated golf shot corresponding to a correct answer and an incorrect answer are provided. Two to four players, or up to four teams of any number of players on a team, may play the game 10.

To begin play, each player positions a playing piece 30 on the tee area 23 of a first playing hole 22 of the plurality of playing holes 22 of the golf course 21. Each player rolls the die 32, and the player receiving the highest roll of the die 32 begins play. The player rolls the die 32 to determine from which of the number of subject matter categories a question shall be selected. One of the plurality of query cards 40 is selected and a question is read corresponding to the result of the rolled die 32. The player provides an answer to the read question and a determination is made as to whether the provided answer is correct.

The player then selects one of the plurality of golf club cards 50 corresponding to a desired golf club 53 through 65 for making a simulated golf shot from the tee area 23 of the first playing hole 22 of the plurality of playing holes 22 of the golf course 21. The playing piece 30 is moved to a resulting shot position according to the outcome provided on the selected golf club card 50 corresponding to the correctness of the provided answer.

The traditional rules of golf apply during play of the game 10. For example, during play of one of the plurality of playing holes 22, the player who is the furthest distance away from the green area 25 repeats his or her turn. In addition, the player with the lowest score on a previous playing hole 22 begins play on a subsequent playing hole 22. In addition, a maximum stroke limit of ten (10) strokes per playing hole applies. Also, a simulated golf shot that lands in a water area results in a one (1) stroke penalty and a simulated golf shot that lands in an out-of-bounds area results in a two (2) stroke penalty.

Play continues with each player repeating the above steps of rolling the die 32, answering a question from one of the plurality of query cards 40 corresponding to the result of the rolled die 32, selecting a golf club card 50 corresponding to a desired golf club 53 through 65 for making a simulated golf shot from the resulting shot position, and moving the playing piece 30 to a subsequent resulting shot position according to the outcome provided on the golf club card 50 corresponding to the correctness of the provided answer. A single game may consist of completing nine or eighteen playing holes 22 of the golf course 21. The player with the lowest score at the end of nine or eighteen playing holes is declared the winner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Golf Board Game comprising:

a game board having an illustration of a golf course thereon, said golf course divided into a plurality of playing holes;

a plurality of playing pieces to be moved among said plurality of playing holes of said golf course of said game board;

a plurality of query cards, each of said plurality of query cards having a question and an answer provided thereon for each of a number of subject matter categories;

a plurality of golf club cards corresponding to a desired golf club selected for making a simulated golf shot, each of said plurality of golf club cards having a first outcome and a second outcome of said simulated golf shot provided thereon, said plurality of query cards and said plurality of golf club cards determining movement of said plurality of playing pieces among said plurality of playing holes of said golf course of said game board, said first outcome corresponding to a correct answer provided in response to said question from each of said plurality of query cards, said second outcome corresponding to an incorrect answer provided in response to said question from each of said plurality of query cards; and a die for determining from which of said number of subject matter categories said question shall be selected.

2. The Golf Board Game of claim 1, wherein said golf course has eighteen playing holes illustrated thereon.

3. The Golf Board Game of claim 1, wherein each of said plurality of playing holes of said golf course of said game board has a tee area illustrated thereon, a fairway area illustrated thereon, a green area illustrated thereon, and at least one hazard area illustrated thereon.

4. The Golf Board Game of claim 3, wherein said hazard area includes at least one of a bunker area, a water area, a sandtrap area, a tree area, and an out-of-bounds area.

5. The Golf Board Game of claim 3, wherein each of said plurality of playing holes of said golf course of said game board has yardage indicia illustrated thereon.

6. The Golf Board Game of claim 5, wherein said yardage indicia comprises:

horizontal yardage indicia for indicating a horizontal distance between said tee area and said green area, and deviation yardage indicia for indicating a deviation distance from a centerline of said fairway area.

7. The Golf Board Game of claim 1, wherein each of said plurality of playing pieces are in the shape of a golf cart.

8. The Golf Board Game of claim 1, wherein each of said plurality of query cards has a first side and a second side, and wherein said question provided on each of said plurality of query cards is provided on said first side and said answer provided on each of said plurality of query cards is provided on said second side.

9. The Golf Board Game of claim 1, wherein said number of subject matter categories includes a history category, an art and literature category, a sports category, an entertainment category, a geography and nature category, and a miscellaneous category.

10. The Golf Board Game of claim 1, wherein said plurality of golf club cards comprises:

a plurality of driver cards, a plurality of 3 wood cards, a plurality of 4 wood cards, a plurality of 5 wood cards, a plurality of 3 iron cards, a plurality of 4 iron cards, a plurality of 5 iron cards, a plurality of 6 iron cards, a plurality of 7 iron cards, a plurality of 8 iron cards, a plurality of 9 iron cards, a plurality of pitching wedge cards, and a plurality of putter cards.

11. The Golf Board Game of claim 1, wherein said first outcome and said second outcome of said simulated golf shot include at least one of a distance of said simulated golf shot, a direction of said simulated golf shot, a final resting position of said simulated golf shot, and a stroke number for said simulated golf shot.

12. The Golf Board Game of claim 1, wherein each of said plurality of golf club cards has a first side and a second side, and wherein said first outcome of said simulated golf shot provided on each of said plurality of golf club cards is provided on said first side and said second outcome of said simulated golf shot provided on each of said plurality of golf club cards is provided on said second side.

13. The Golf Board Game of claim 1, further comprising:

a plurality of bunker cards for shots from a bunker, and a plurality of chip shot cards for chip shots.

14. The Golf Board Game of claim 1, further comprising:

a scoring card for tracking a number of strokes required for a player to complete each of said plurality of playing holes of said golf course of said game board during play of said game.

15. The Golf Board Game of claim 1, further comprising:

a query card storage box for storage of said plurality of query cards, and a golf club card storage box for storage of said plurality of golf club cards.

16. A method of playing a Golf Board Game, comprising the steps of:

(a) providing a game board having an illustration of a golf course thereon, wherein said golf course is divided into a plurality of playing holes;

(b) providing a plurality of query cards having provided thereon a question and an answer for each of a number of subject matter categories;

(c) providing a plurality of golf club cards having provided thereon an outcome of a simulated golf shot corresponding to a correct answer and an incorrect answer to a question;

(d) positioning a playing piece on a playing hole of said plurality of playing holes of said golf course:

(e) rolling a die to determine from which of said number of subject matter categories a question shall be selected;

(f) selecting one of said plurality of query cards and reading a question from said selected query card corresponding to a result of said rolled die;

(g) providing an answer to said read question and determining whether said provided answer is correct;

(h) selecting one of said plurality of golf club cards corresponding to a desired golf club for making a simulated golf shot on said playing hole;

(i) moving said playing piece to a resulting shot position according to an outcome provided on said selected golf club card corresponding to the correctness of said provided answer; and (j) repeating steps (e) through (i) above to complete play of said playing hole.

* * * * *